United States Patent [19]

Richards

[11] 3,958,501

[45] May 25, 1976

[54] APPARATUS FOR FORMING A CONVOLUTED CONTAINER SIDEWALL

[75] Inventor: Frank P. Richards, Kansas City, Mo.

[73] Assignee: Phillips Petroleum Company, Bartlesville, Okla.

[22] Filed: Oct. 18, 1974

[21] Appl. No.: 515,872

[52] U.S. Cl. ..... 93/39 C; 93/39.2; 93/44.1 R; 93/81 MT

[51] Int. Cl.[2] ..... B31B 1/32

[58] Field of Search ..... 93/36.1, 39 C, 39 R, 93/39.1 R, 39.2, 39.3, 54 R, 54.2, 54.3, 44, 44.1 R, 81 R, 81 MT

[56] References Cited

UNITED STATES PATENTS

| | | | |
|---|---|---|---|
| 1,876,931 | 9/1932 | Heywood et al. | 93/39.3 |
| 2,237,828 | 4/1941 | Hatch et al. | 93/39.2 X |
| 2,245,900 | 6/1941 | Carew | 93/36.1 |
| 2,942,530 | 6/1960 | Bodendoerfer | 93/39.3 X |
| 3,745,891 | 7/1973 | Bodendoerfer | 93/39 C X |

*Primary Examiner*—James F. Coan

[57] ABSTRACT

Apparatus for wrapping a sidewall blank about a mandrel utilizing two wrapping wings which are rotated about the mandrel axis by respective drive trains, one of the drive trains containing a lost motion mechanism.

16 Claims, 8 Drawing Figures

APPARATUS FOR FORMING A CONVOLUTED CONTAINER SIDEWALL

This invention relates to apparatus for wrapping a sidewall blank about a mandrel to form a convoluted sidewall.

When a blank is wrapped around a mandrel by using two wiper blades, the blade wiping the end of the blank which will be the inside ply at the lap must stop while the outer ply is wiped across the lap seam. This can be accomplished with each wiper blade controlled by its own individual cam and lever system. However, cams are expensive to design and to manufacture, and are not adapted to adjustments. Accordingly, a mechanism which avoids or at least minimizes the use of cams and which permits adjustments to be made easily is desirable.

Therefore it is an object of the present invention to provide a new and improved apparatus for forming a convoluted tube. Another object of the invention is to provide a drive mechanism for two folding wings which minimizes the use of cams. Yet another object of the invention is to provide adjustability in the drive system for two folding wings. Other objects, aspects and advantages of the invention will be apparent from a study of the specification, the drawings and the appended claims to the invention.

In the drawings

Figure 1:
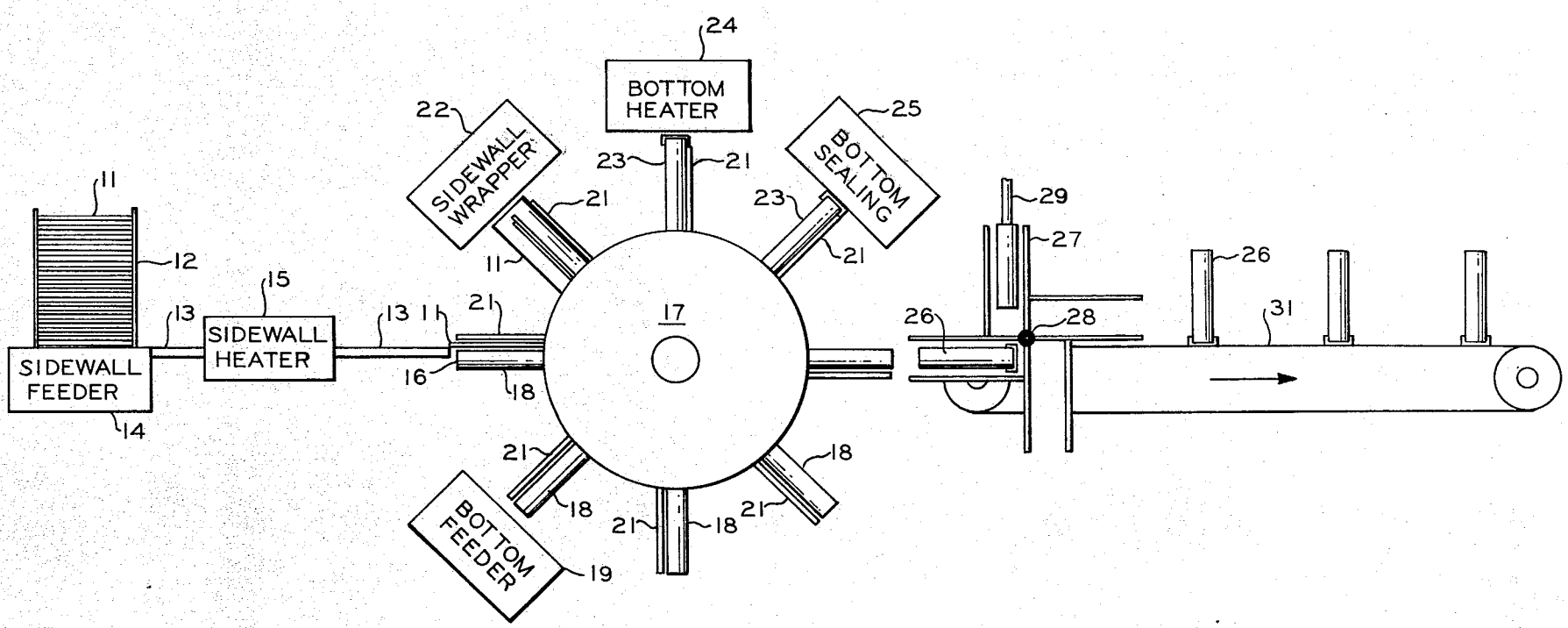
FIG. 1 is a diagrammatic representation of a container forming machine embodying the present invention.

Referring now to FIG. 1 in detail, thermoplastic coated paperboard sidewall blanks 11 are individually withdrawn from magazine 12 and transferred to conveyor 13 by sidewall feeder 14. The blank 11 is passed through sidewall heater 15 to heat to a suitable bonding temperature the thermoplastic coating in the side marginal positions which are to be overlapped in the formation of the sidewall into a container and, if desired, in the bottom marginal position which is to be bonded to the bottom member 16. Turret 17 is mounted for rotation about its horizontal axis and is provided with a plurality of mandrels 18 which extend radially outwardly from said horizontal axis in a vertical plane perpendicular to said horizontal axis. The mandrels 18 are spaced apart on the turret 17 in a uniform manner. A suitable bottom feeder mechanism 19, for example a chip feeder, supplies individual bottom members 16 to the outermost end face of mandrels 18. Each mandrel 18 is provided with suitable means, for example a suction means, to hold the bottom member 16 in place on the end face of the mandrel. The turret rotates, stepwise, in a clockwise direction as viewed in FIG. 1, to move a bare mandrel to the bottom feeding station to receive a bottom member 16 and then to the horizontal position in alignment with conveyor means 13 to receive a heated blank 11. Each mandrel 18 has a sidewall clamp 21 associated therewith which is in the open position, spaced apart from its mandrel 18, at the sidewall blank receiving station to permit the heated blank 11 to be inserted between the mandrel 18 and clamp 21 by conveyor means 13. The clamp 21 is then actuated to secure the median or intermediate portion of the heated blank 11 in position on mandrel 18, after which the turret 17 is indexed to the next position to carry the secured blank 11 and bottom member 16 to the sidewall wrapping station. The sidewall wrapping means 22 wraps the blank 11 around mandrel 18 to form a convolute and to apply pressure to the overlapped heated side margins to bond the side margins, thereby forming a tubular sidewall 23.

At the next indexing of turret 17, the mandrel carrying the tubular sidewall 23 is moved from the sidewall wrapping station to the bottom heating station, where the margin of the sidewall adjacent the bottom member 16 is heated by bottom heating means 24 to a suitable bonding temperature. The turret 17 is then indexed to transport the mandrel 18 and the heated sidewall 23 to a bottom sealing station, where bottom sealing means 25 applies pressure to the heated portions of the sidewall 23 and bottom member 16 to form the bottom seal. In one embodiment the bottom member 16 has a shape at least substantially equal to the shape of the end face of mandrel 18, and the bottom margin of the tubular sidewall 23 is folded inwardly into contact with the bottom member 16 to form the bottom seam. A container of this type is illustrated by I. L. Wilcox in U.S. Pat. No. 3,369,726, issued Feb. 20, 1968. In another embodiment the bottom member 16 can be formed with a central disc portion having a diameter substantially equal to the diameter of the end face of mandrel 18 and an annular flange portion folded to extend outwardly from the mandrel 18 at least approximately parallel to the side surface of the mandrel 18. In the latter embodiment the flange portion of the bottom member 16 can be bonded to the contacting surface of the tubular sidewall 23. If desired, the tubular sidewall bottom margin can be longer than the flange of bottom disc member 16 to permit the bottom margin to be folded approximately 180° to form a U which contacts both sides of the flange of bottom member 16. If desired, the bottom seam can be rolled by suitable known means. Where the bottom member 16 is flanged, bottom feeder 19 can employ a suction cup transfer mechanism, or flat discs can be chip fed and then forced through a die to form the flange and then applied to the end face of mandrel 18.

After the bottom seal is formed, the turret 17 is indexed to transport the formed container 26 to a stripping station, and the associated clamp 21 is moved to the open position to release the container 26. Although any suitable mechanical stripping means can be employed, it is presently preferable to utilize pneumatic pressure applied through the mandrel to the inside of the container to eject the container from the mandrel 18 into a pocket of turret 27. Turret 27 is rotated stepwise about horizontal axis 28 to move the ejected container 26 from the initial horizontal position to a vertical position with the open end up. A pusher arm 29 is moved through the upright pocket of turret 27 to move the container 26 onto conveyor 31. If desired, two conveyors can be positioned on opposite sides of turret 27 and pusher arm 29 can move alternate containers to opposite conveyors.

Figure 7:
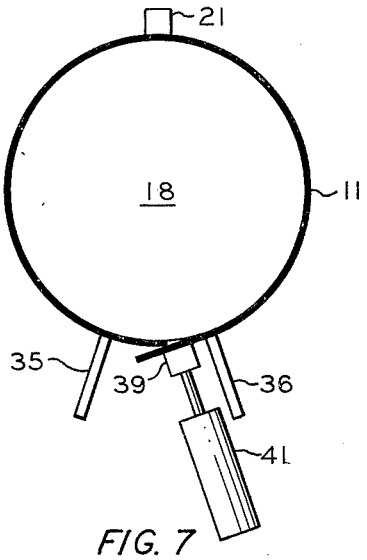
Figure 8:
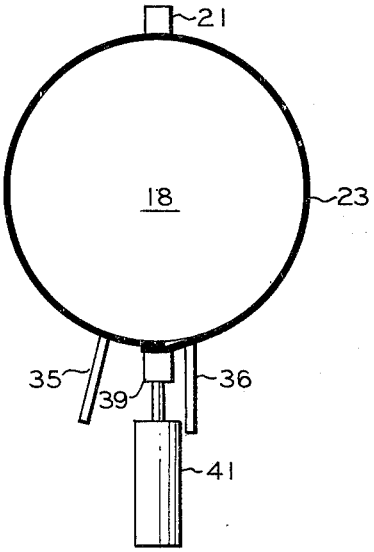

Referring now to FIGS. 4 to 8, bottom member 16 is illustrated as having a central disc portion 32 and an annular flange portion 33 and is held in place on the end face of mandrel 18 by the subatmospheric pressure maintained in conduit 34 and its branches. Spring biased wiping blades 35 and 36, carried by folding wing 37 and 38 respectively, contact the outer surface of sidewall blank 11 on opposite sides of the respective clamp 21 when mandrel 18 is indexed into the sidewall wrapping station. The folding wings 37 and 38 are then actuated to rotate about the longitudinal axis of the mandrel 18 in opposite directions to wrap the sidewall blank 11 around mandrel 18 to form the convolute container sidewall 23 in the sequence shown by FIGS. 6 to 8. When the degree of rotation illustrated in FIG. 7 is achieved, the rotation of blade 35 stops while the rotation of blade 36 and the associated sealing head 39 continues until the position illustrated in FIG. 8 is reached. Blade 35 can lead blade 36 by a few degrees so that when blade 35 stops, blade 35 holds the left edge portion of sidewall blank 11 generally against mandrel 18 while blade 36 and sealing head 39 continue to rotate to cause the right edge portion of blank 11 to overlap the left edge portion thereof. When the rotation of blade 36 is completed, sealing head 39 is actuated by piston 40 of pneumatic cylinder 41 to press the heated right edge portion of blank 11 against the heated left edge portion thereof to achieve a thermal bonding of the thermoplastic coatings and thereby form the convoluted container sidewall 23.

Referring now to FIGS. 2–5, the actuation mechanism of sidewall wrapping means 22 comprises a carriage 42 which is mounted for lateral forward and retractive motion in guide tracks 43 and 44 secured to housing 45. The motion of carriage 42 is effected by rod 46, which is actuated by oscillating shaft 47, bracket 48, rocker arm 49 and connecting linkage 51. Shaft 47 can be oscillated by a cam in the indexing mechanism for turret 17. Carriage 42 carries a fixed gear rack 52 and a floating gear rack 53. The floating gear rack 53 is secured to rods 54 and 55 which are slidably mounted in brackets 56 and 57, respectively. Rack 53 is free to move relative to the carriage 42 between brackets 56 and 57 by overcoming the pressure of spring 58 and its associated pressure adjusting screw 59 against rod 54.

The floating gear rack 53 meshes with a pinion gear 61 which is secured to inner shaft 62. The fixed gear rack 52 is mounted on carriage 42 at a lower level than floating gear rack 53 and meshes with a pinion gear 63 which is secured to outer shaft 64. Shaft 64 is a hollow sleeve which is mounted concentrically about inner shaft 62 by means of bushings 65 and 66. Shaft 64 is supported in housing 67 by bushing 68. Housing 67 is supported by plate 69, which is a part of housing 45. The upper end of shaft 62 is supported in bar 71 by bearing 72, with bar 71 being part of housing 45. Arm 73 is mounted on the lower end of inner shaft 62 for rotation therewith, and folding wing 37 is secured to the underside of arm 73. Arm 74 is mounted on the lower end of outer shaft 64 for rotation therewith, and folding wing 38 is secured to the underside of arm 74. Pneumatic cylinder 41 can be mounted horizontally on folding wing 38, as illustrated, or cylinder 41 can be mounted vertically with the piston 40 actuating a spring biased horizontal plunger via a rocker arm assembly.

A stop 75 is adjustably mounted on housing 45 in the path of movement of rod 55. The position of stop 75 is adjusted so that rod 55 contacts stop 75 at the moment folding wing 37 and blade 35 reach the desired terminal position shown in FIG. 7. The contact of stop 75 and rod 55 stops the motion of floating gear rack 53, and thus stops the rotation of pinion gear 61, inner shaft 62, arm 73, folding wing 37 and blade 35. The continued forward motion, to the left in FIG. 2, of carriage 42 compresses spring 58, but does not move floating rack 53, while the continued motion of fixed rack 52 completes the rotation of pinion gear 63, outer shaft 64, arm 74, folding wing 38, blade 36 and sealing head 39 to the terminal position shown in FIG. 8. Upon the termination of the movement of folding wing 38, pneumatic cylinder 41 is actuated to move sealing head 39 to press together the previously heated overlapped side margins of the convoluted blank 11 to effect a bonding together of these overlapped portions, thereby forming a tubular sidewall 23.

Figure 2:
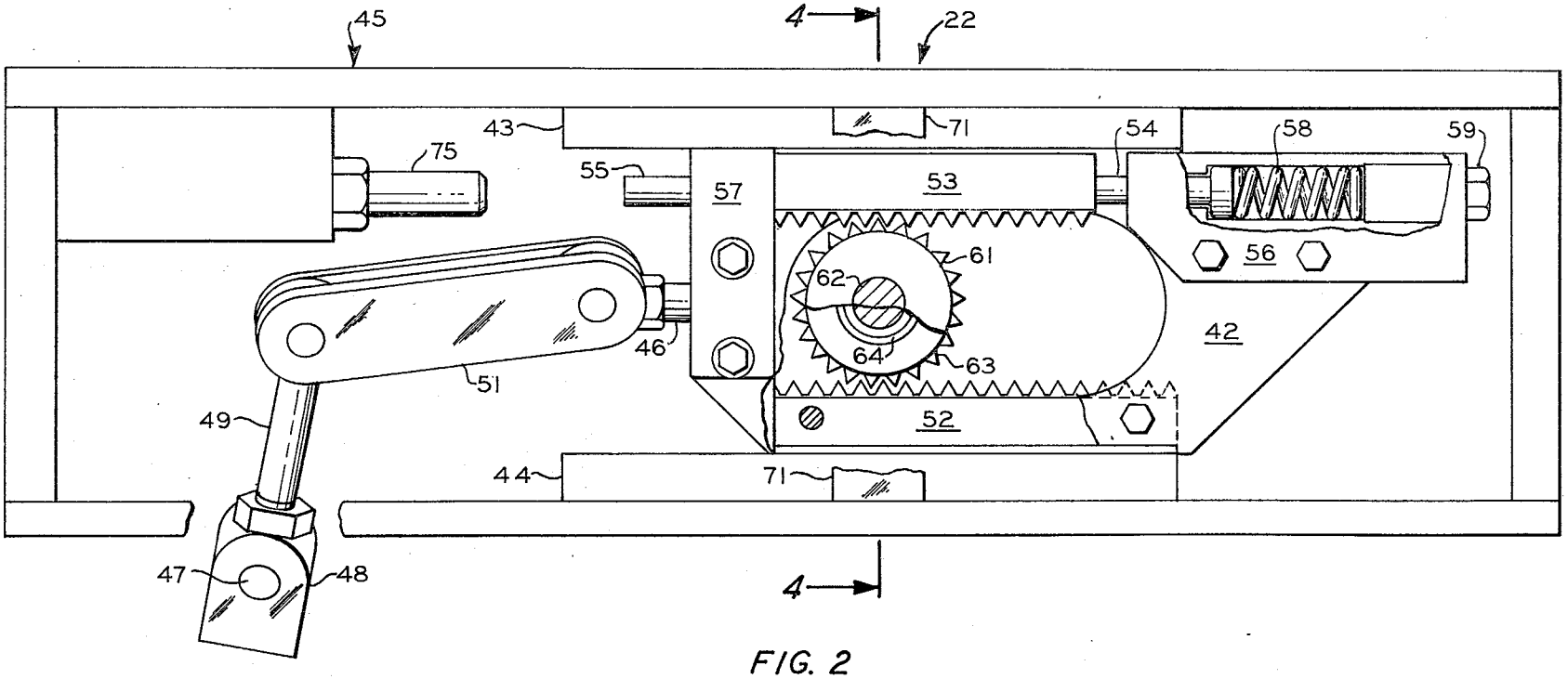
FIG. 2 is a plan view, partly in cross section, of the lost motion mechanism of the sidewall wrapper station of FIG. 1 in the open position.
Figure 3:
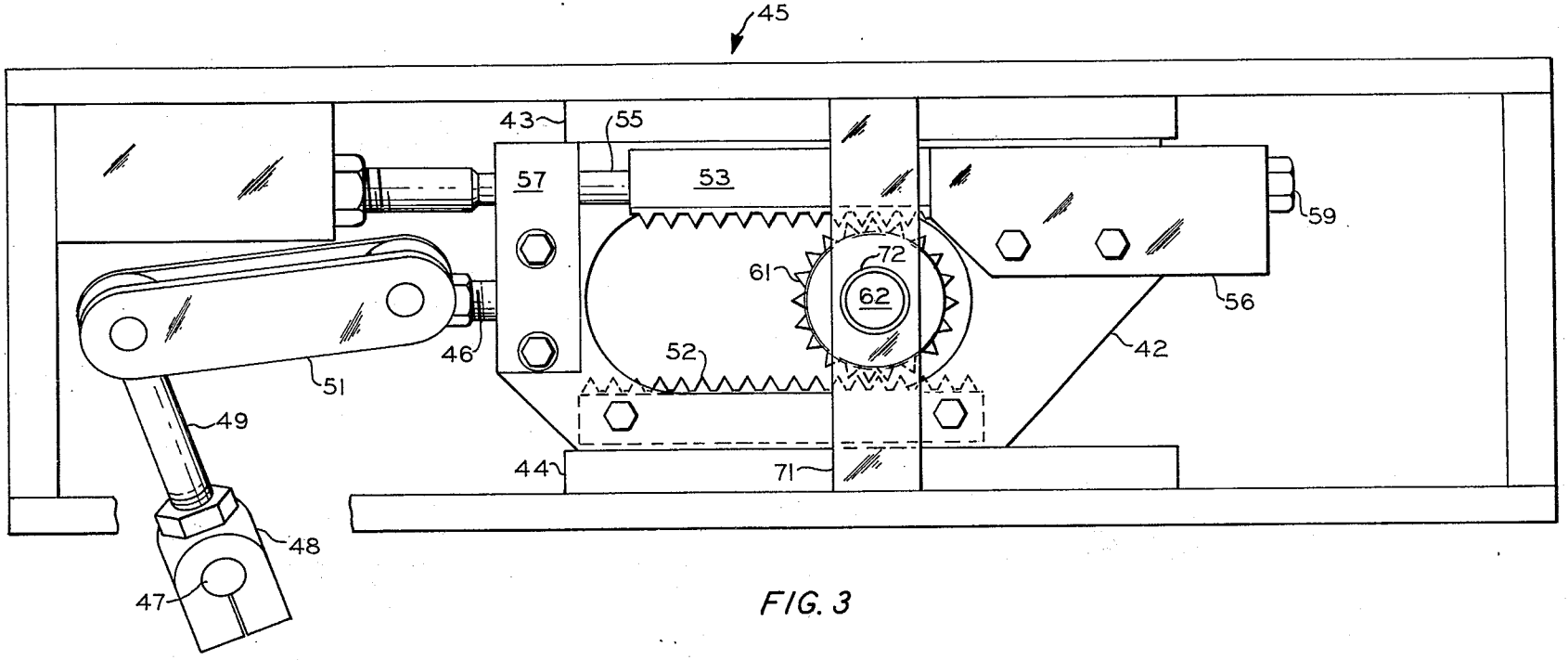
FIG. 3 is a plan view of the lost motion mechanism in the closed position.
Figure 4:
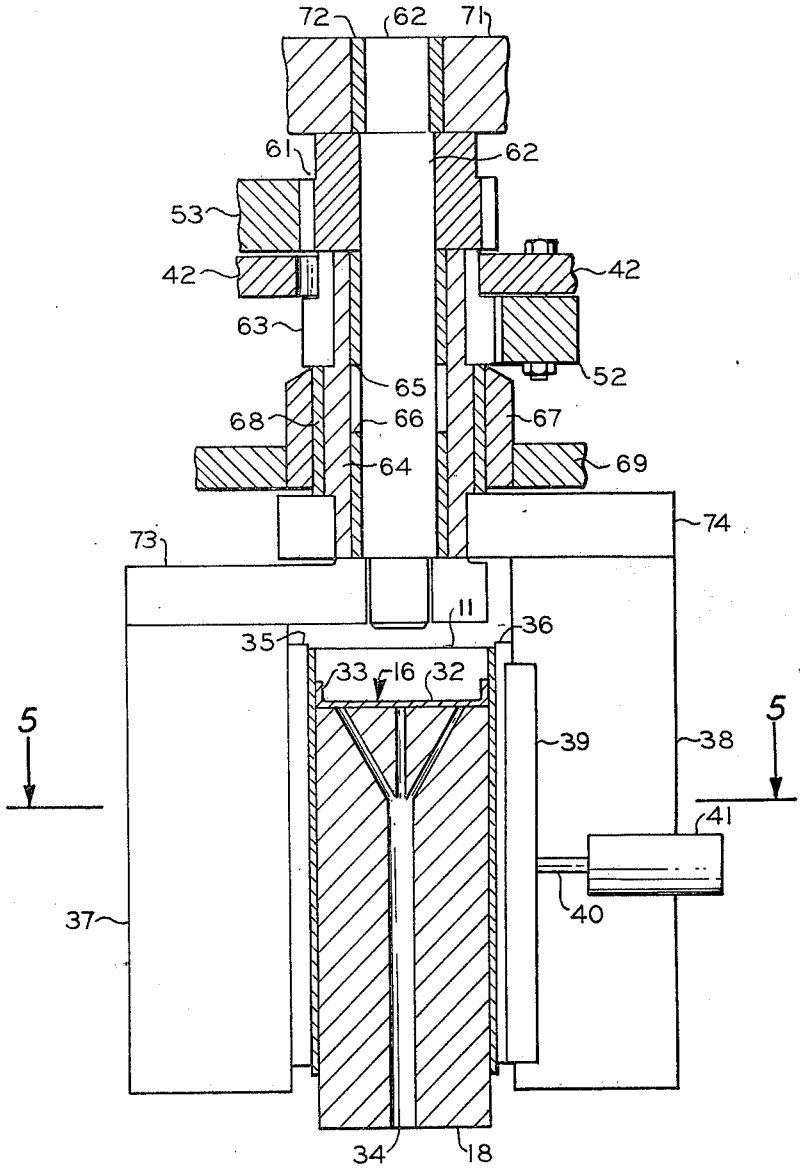
FIG. 4 is a partial elevational view in cross section taken along the line 4—4 in FIG. 2.
Figure 5:
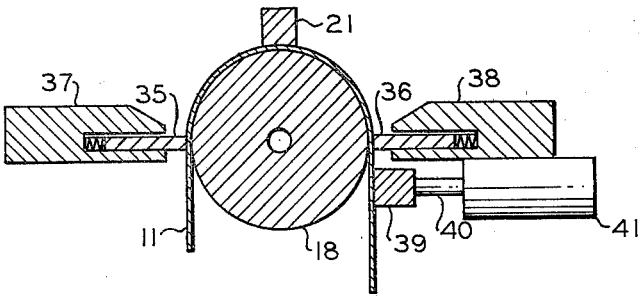
FIG. 5 is a cross-sectional view taken along line 5—5 in FIG. 4.
Figure 6:
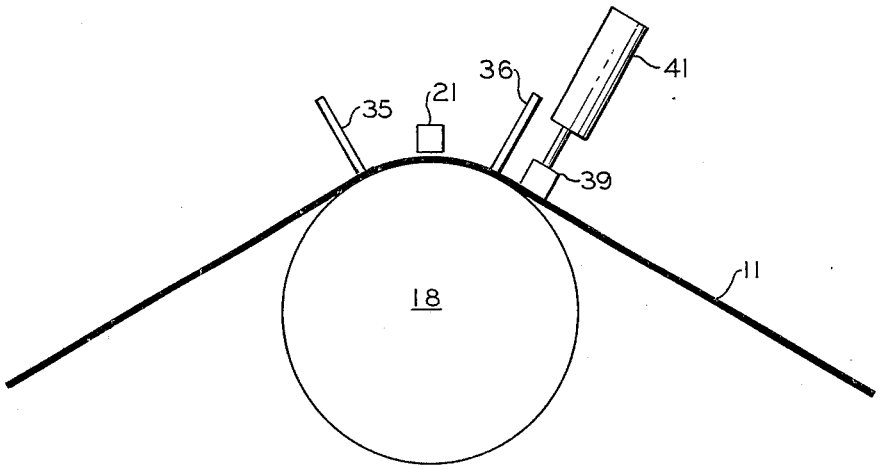
FIGS. 6, 7 and 8 are simplified views similar to FIG. 5 showing the wrapping mechanism in three sequential stages of operation.

During the retraction half cycle, the carriage 42 is moved to the right as viewed in FIG. 2. During the initial portion of the retraction movement of carriage 42, rod 55 remains against stop 75 as a result of spring 58, while the movement of fixed rack 52 rotates gear 63 to begin the retraction of folding wing 38 and the associated sealing. As soon as carriage 42 has been retracted sufficiently for bar 57 to contact rack 53, gear 61 is actuated to rotate folding wing 37 to its retracted position for the next cycle.

While driving elements 52 and 53 have been illustrated as gear racks and driven elements 61 and 63 have been illustrated as pinion gears, other suitable mechanisms can be employed. For example, bars having a roughened surface could be employed as the driving elements in combination with rollers as the driven elements, the rollers being in frictional engagement with the roughened surfaces of the driving elements. Also, while the invention has been illustrated in terms of the manufacture of a cylindrical container, it can be utilized for the manufacture of a frustoconical container. Other reasonable variations and modifications are possible within the scope of the foregoing disclosure, the drawings and the appended claims to the invention.

What is claimed is:

1. Apparatus for wrapping a blank about a mandrel to form a convoluted tubular sidewall, which comprises a mandrel, a clamping means associated with said mandrel to hold an intermediate portion of a blank therebetween, first and second folding wing means positioned to contact the outer surface of the thus held blank on opposite sides of said clamping means, means for rotating said first and second folding wing means about the axis of said mandrel to wrap the blank about said mandrel and for terminating the rotation of said second folding wing means about said axis before the opposite side margins of the blank are overlapped by the continued rotation of said first folding wing means about said axis, and means for sealing the thus overlapped side margins to thereby form a convoluted tubular sidewall; said means for rotating comprising a carriage, guide means for supporting said carriage, means for effecting forward and retractive motion of said carriage in said guide means in a reciprocating manner, a first driving element fixedly secured to said carriage, a second driving element mounted on said carriage and adapted to move between a first position and a second position with respect to said carriage, means for resiliently biasing said second driving element to said first position, first and second shafts, said first folding wing means being secured to said first shaft for rotation therewith, said second folding wing means being secured to said second shaft for rotation therewith, a first driven element secured to said first shaft for rotation therewith, a second driven element secured to said second shaft for rotation therewith, said first and second driven elements engaging said first and second driving elements, respectively, and stop means for terminating the movement of said second driving element during the final portion of the forward motion of said carriage so that the continued motion of said carriage with respect to said second driving element places said second driving element in said second position.

2. Apparatus in accordance with claim 1 wherein said first and second driving elements are gear racks and wherein said first and second driven elements are pinion gears.

3. Apparatus in accordance with claim 2 wherein one of said first and second shafts is a sleeve, with said sleeve being positioned about and coaxially with the other of said first and second shafts.

4. Apparatus in accordance with claim 3 wherein each of said first and second folding wing means comprises a folding wing, a wiper blade for contacting the blank, and means for resiliently mounting the wiper blade in the respective folding wing.

5. Apparatus in accordance with claim 4 wherein said second driving element has first and second rod elements projecting therefrom and slidably engaging first and second portions of said carriage to support said second driving element on said carriage, said first rod element extending through said first portion of said carriage, said means for resiliently biasing being associated with said second rod element to bias said second driving element against said first portion of said carriage, said stop means being adjustably positioned in the path of movement of said first rod element to stop the forward motion of said first driving element while permitting said carriage to continue its forward motion.

6. Apparatus in accordance with claim 5 wherein there are a plurality of mandrels mounted on a turret, each of said mandrels having a said clamping means associated therewith, further comprising means for indexing said turret to sequentially move each mandrel into a sidewall wrapping station, said first and second folding wing means and said means for rotating said first and second folding wing means being located at said sidewall wrapping station to cooperate with the respective mandrel positioned in said sidewall wrapping station.

7. Apparatus in accordance with claim 1 wherein one of said first and second shafts is a sleeve, with said sleeve being positioned about and coaxially with the other of said first and second shafts.

8. Apparatus in accordance with claim 1 wherein each of said first and second folding wing means comprises a folding wing, a wiper blade for contacting the blank, and means for resiliently mounting the wiper blade in the respective folding wing.

9. Apparatus in accordance with claim 1 wherein said second driving element has first and second rod elements projecting therefrom and slidably engaging first and second portions of said carriage to support said second driving element on said carriage, said first rod element extending through said first portion of said carriage, said means for resiliently biasing being associated with said second rod element to bias said second driving element against said first portion of said carriage, said stop means being adjustably positioned in the path of movement of said first rod element to stop the forward motion of said first driving element while permitting said carriage to continue its forward motion.

10. Apparatus in accordance with claim 1 wherein there are a plurality of mandrels mounted on a turret, each of said mandrels having a said clamping means associated therewith, further comprising means for indexing said turret to sequentially move each mandrel into a sidewall wrapping station, said first and second folding wing means and said means for rotating said first and second folding wing means being located at said sidewall wrapping station to cooperate with the respective mandrel positioned in said sidewall wrapping station.

11. Apparatus in accordance with claim 3 wherein said second driving element has first and second rod elements projecting therefrom and slidably engaging first and second portions of said carriage to support said second driving element on said carriage, said first rod element extending through said first portion of said carriage, said means for resiliently biasing being associated with said second rod element to bias said second driving element against said first portion of said carriage, said stop means being adjustably positioned in the path of movement of said first rod element to stop the forward motion of said first driving element while permitting said carriage to continue its forward motion.

12. Apparatus in accordance with claim 3 wherein there are a plurality of mandrels mounted on a turret, each of said mandrels having a said clamping means associated therewith, further comprising means for indexing said turret to sequentially move each mandrel into a sidewall wrapping station, said first and second folding wing means and said means for rotating said first and second folding wing means being located at said sidewall wrapping station to cooperate with the respective mandrel positioned in said sidewall wrapping station.

13. Apparatus in accordance with claim 7 wherein each of said first and second folding wing means comprises a folding wing, a wiper blade for contacting the blank, and means for resiliently mounting the wiper blade in the respective folding wing.

14. Apparatus in accordance with claim 7 wherein said second driving element has first and second rod elements projecting therefrom and slidably engaging first and second portions of said carriage to support said second driving element on said carriage, said first rod element extending through said first portion of said carriage, said means for resiliently biasing being associated with said second rod element to bias said second driving element against said first portion of said carriage, said stop means being adjustably positioned in the path of movement of said first rod element to stop the forward motion of said first driving element while permitting said carriage to continue its forward motion.

15. Apparatus in accordance with claim 14 wherein each of said first and second folding wing means comprises a folding wing, a wiper blade for contacting the blank, and means for resiliently mounting the wiper blade in the respective folding wing.

16. Apparatus in accordance with claim 7 wherein there are a plurality of mandrels mounted on a turret, each of said mandrels having a said clamping means associated therewith, further comprising means for indexing said turret to sequentially move each mandrel into a sidewall wrapping station, said first and second folding wing means and said means for rotating said first and second folding wing means being located at said sidewall wrapping station to cooperate with the respective mandrel positioned in said sidewall wrapping station.

* * * * *